US005207261A

United States Patent [19]

Quezel Castraz

[11] Patent Number: 5,207,261

[45] Date of Patent: May 4, 1993

[54] VENETIAN BLIND

[75] Inventor: Marc J.A.C. Quezel, Passy, France

[73] Assignee: Somfy, France

[21] Appl. No.: 832,969

[22] Filed: Feb. 10, 1992

[30] Foreign Application Priority Data

Feb. 22, 1991 [FR] France ..... 91 02160

[51] Int. Cl.[5] ..... E06B 9/26

[52] U.S. Cl. ..... 160/176.1; 160/170

[58] Field of Search ..... 160/176.1, 168.1, 170, 160/171, 177, 172, 178.1, 173, 174, 175

[56] References Cited

U.S. PATENT DOCUMENTS 2,182,804 12/1939 Haase ..... 160/176.1
2,604,939 7/1952 Griesser ..... 160/171
4,200,135 4/1980 Hennequin ..... 160/176.1 X
4,334,572 6/1982 Frei ..... 160/170
4,917,168 4/1990 Chen ..... 160/176.1

*Primary Examiner*—David M. Purol
*Attorney, Agent, or Firm*—Laff, Whitesel, Conte & Saret

[57] ABSTRACT

A venetian blind includes a winding drum (5), on which is wound a cord (8) fastened to the lowermost slat (10) of the blind, and a mechanism for orienting the slats of the blind, including a flexible ladder which is driven frictionally and the bands (15, 16) of which are fastened to the slats of the blind for their orientation.

The orientation device includes a slide (17) mounted elastically and displaced transversely by the cord (8) when a pulling force is exerted on the cord. The slide controls the passage of stop pieces (27, 28) fixed to the ladders and consequently the orientation of the slats of the blind.

11 Claims, 7 Drawing Sheets

FIG 13
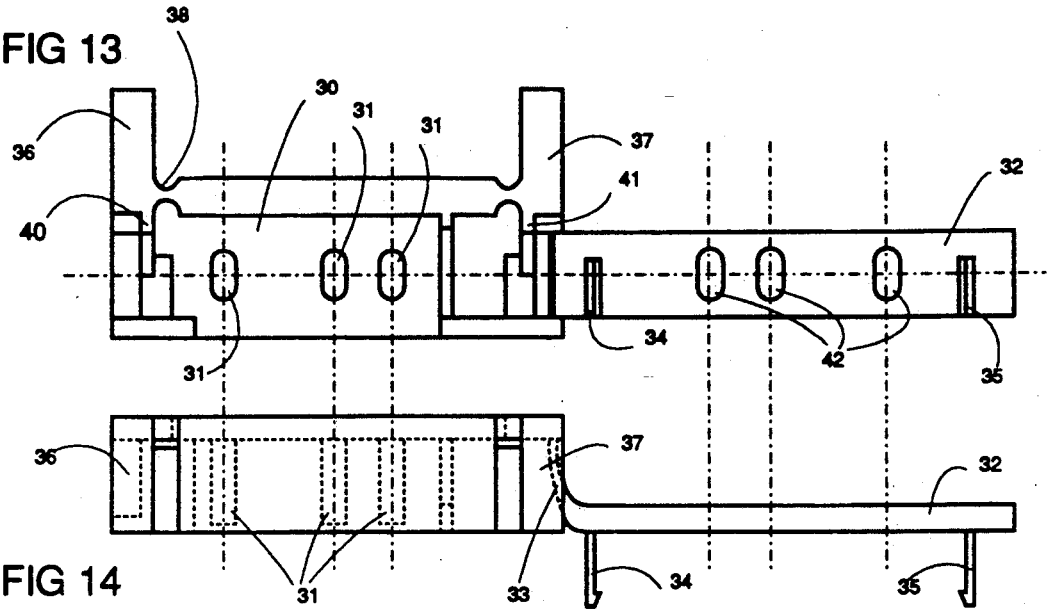
FIG 14
FIG 15
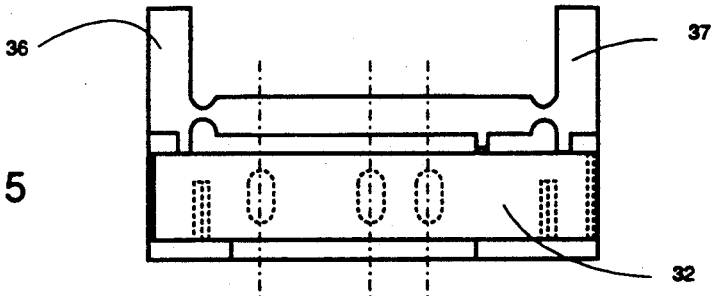
FIG 16
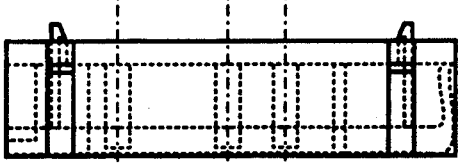
FIG 17
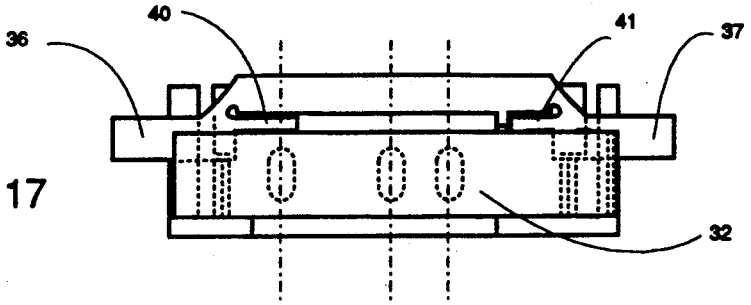

VENETIAN BLIND

BACKGROUND OF THE INVENTION

The subject of the present invention is a Venetian blind comprising a winding shaft, on which is mounted at least one winding drum, on which is wound a cord fastened to the lowermost slat of the blind and passing through the other slats in their middle part, and a slat orientation mechanism comprising a pulley frictionally driving a flexible ladder, the ends of the sides of which are connected to two bands fastened to each of the edges of the slats in order to ensure that these slats tilt into the closed position when the blind is completely unwound, and a movable member positioned elastically and subjected to the action of the cord under the effect of the pull exerted on the cord by the lowermost end slat, this movable member controlling stop means keeping the slats in a first inclination when they are operative and allowing the slats to tilt into a second inclination when they are inoperative.

A blind of this type is known from the patent DE 3,205,491. In this blind, the movable member consists of a pusher mounted at the end of an elastic arm parallel to the axis of the pulley and bending under the pressure of the cord wound on the pulley. This pusher acts on a slide forming a retractable stop for one of the ends of a helical spring of a friction-spring clutch, the slackening of the cord having the effect of retracting this stop and allowing the clutch to ensure that the ladder is driven at an angle determined by a stationary stop. The orientation mechanism comprises approximately seven parts and it is not symmetrical, that is to say it can be used only in a single direction of rotation.

An orientation mechanism of the same type as the abovementioned mechanism is also known from the patent application DE 3,037,701. However, there, the control of the spring of the clutch is obtained in an appreciably more complicated way, with the result that the mechanism comprises between fifteen and eighteen parts.

The patent application EP 0,050,677 discloses, furthermore, an orientation mechanism which likewise comprises a bar elastically mounted parallel to the axis of the winding pulley and subjected to the action of the cord, this bar being equipped with two radial pawls which drive the inner side of the ladder by means of a driver fastened to this side, thereby causing the slats of the blind to tilt into the closed position when the bar is relieved. The bar also serves as a means for coupling the drum of the ladder to the winding pulley. This mechanism comprises approximately seven parts and it is not symmetrical.

These three mechanisms moreover have the common characteristic of possessing parts which work radially, thus limiting the diameter of the drive shaft and making it virtually impossible to mount the mechanism on a tubular motor. Furthermore, the asymmetry of these mechanisms makes it necessary to take special precautions for the orientation of the mechanism during the assembly operation.

SUMMARY OF THE INVENTION

The object of the present invention is to provide a slat orientation mechanism which is simpler than the known mechanisms and is capable of being produced in a symmetrical form, that is to say one which can be used in both directions of rotation and the mounting of which is consequently independent of the orientation of the drive shaft of the blind.

The blind according to the invention is characterised in that the drum of the cord and the pulley of the ladder are integral with one another, in that the elastically positioned movable member consists of a piece capable of being displaced in a horizontal plane in a direction transverse relative to the axis of the drum in relation to a stationary frame having a central passage for the cord and two lateral passages, controlled by the slide, for each of the sides of the ladder, the cord passing through this movable piece in such a way that a pull on the cord has the effect of displacing said movable piece counter to its elastic positioning means, and in that the sides of the ladder are each equipped with a stop piece, the dimensions of the lateral passages, of the stop pieces and of the movable piece being such that, when the movable piece is subjected to stress by the cord, the stop pieces cannot pass through said lateral passages and the slats of the blind have the first inclination, whereas, when the movable piece is not subjected to stress by the cord, the ascending stop piece can pass through the corresponding passage and allow the slats to tilt into the second inclination.

The mechanism is very simple and symmetrical. The absence of a movable piece in the pulley makes it possible to pass a shaft of large cross-section through the pulley and, in particular, to mount the pulley on a tubular motor.

The mechanism is preferably produced symmetrically in relation to a vertical plane of symmetry parallel to the axis of the winding shaft, in particular passing through this axis.

The winding drum and the pulley of the ladder can be produced as one piece rotating in a cradle forming the frame. In this case, the complete mechanism consists of three parts plus one or two springs for the positioning of the movable piece.

It is possible to reduce the number of parts to two parts only if the cradle and the movable piece are produced in one piece from injection-moulded plastic, the movable piece being connected to the cradle by means of thin arms forming said elastic means for positioning the slide.

BRIEF DESCRIPTION OF THE DRAWINGS

The accompanying drawing illustrates some embodiments of the blind according to the invention by way of example.

FIG. 13 is an elevation view of a particular embodiment of the end stop of the ladder in the open position.

FIG. 14 is a plan view of this same stop in the open position.

FIG. 15 is an elevation view of this same stop in the closed position and with the arms in the inoperative position.

FIG. 16 is a plan view of the closed stop illustrated in FIG. 15.

FIG. 17 shows the same stop with its arms in the operative position.

DESCRIPTION OF THE PREFERRED EMBODIMENT(S)

Figure 1:
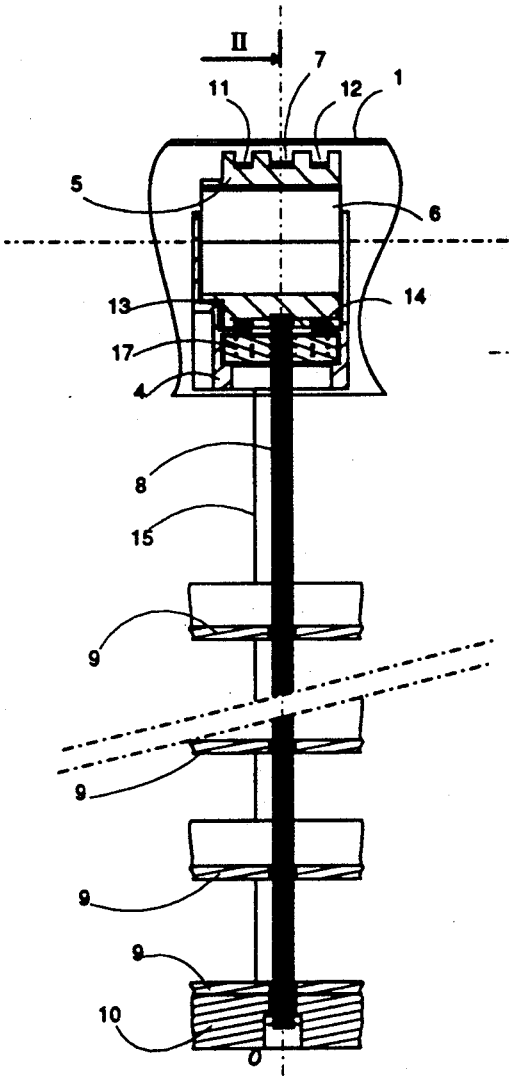
FIG. 1 is a sectional view according to line I—I of FIG. 2 showing the blind at the start of its ascent phase.
Figure 2:
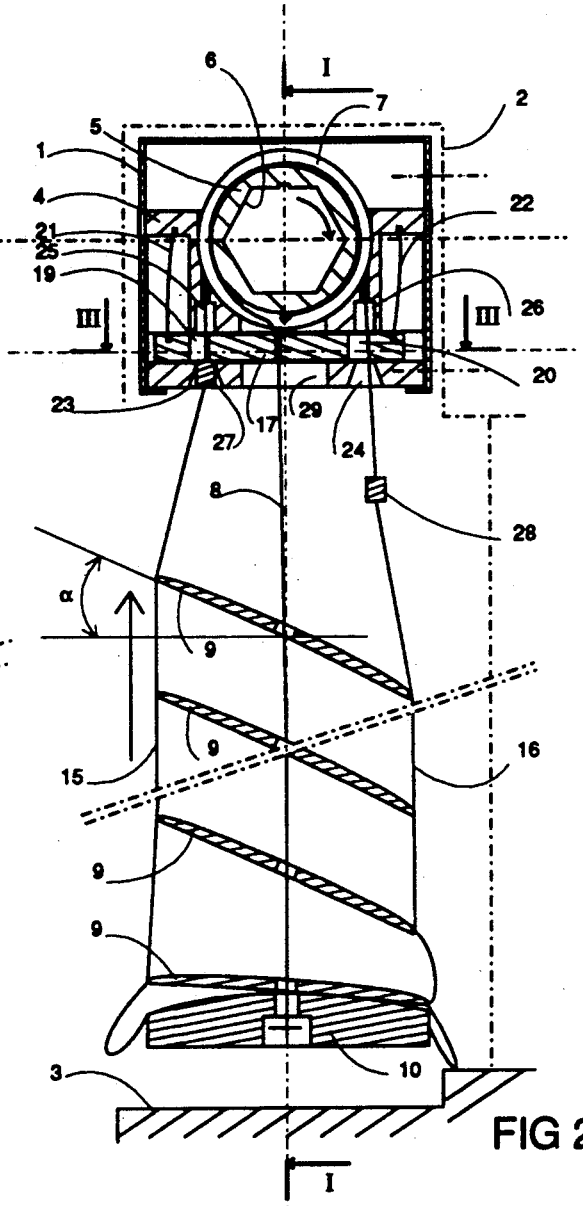
FIG. 2 is a sectional view according to line II—II of FIG. 1.
Figure 3:
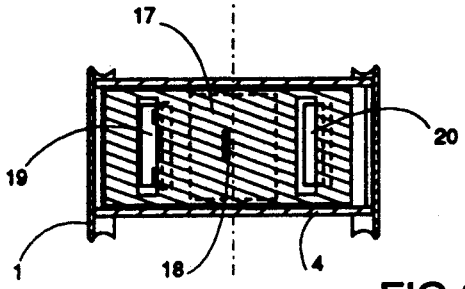
FIG. 3 shows the slide in a sectional view according to line III—III of FIG. 2.

The blind shown in FIGS. 1 to 3 comprises a rectangular metal box 1, shown partially in FIG. 1, in which are mounted a plurality of winding and orientation units for the Venetian blind, only one of these units being illustrated in the drawing. The box 1 is mounted in a window groove 2 represented by dot-and-dash lines, with the exception of its lower edge 3.

The winding and orientation unit illustrated comprises a cradle 4 which is fastened to the box 1 and in which is seated rotatably a tubular piece 5 of general cylindrical shape, having an axial passage of hexagonal shape intended for locking it onto a tubular motor. This piece 5 has a middle groove 7 forming a winding drum for the cord 8 of the blind, said cord passing freely in a way known per se through the intermediate slats 9 of the blind and being attached to the lowermost end slat 10. The piece 5 possesses, furthermore, two grooves 11 and 12 arranged on either side of the groove 7 and forming two pulleys, in which pass two straps 13 and 14, the ends of which are attached in a way known per se to the ends of two bands 15 and 16 fastened in a way known per se to each of the edges of each of the slats 9 and 10 of the blind. It is customary to speak of a ladder for the assembly consisting of the straps 13 and 14 and of the bands 15 and 16 and of a ladder carrier for the straps 13 and 14. The ladder carrier is driven frictionally by the piece 5 when the latter is driven in rotation.

Figures 5, 6, 7, 8, 9:
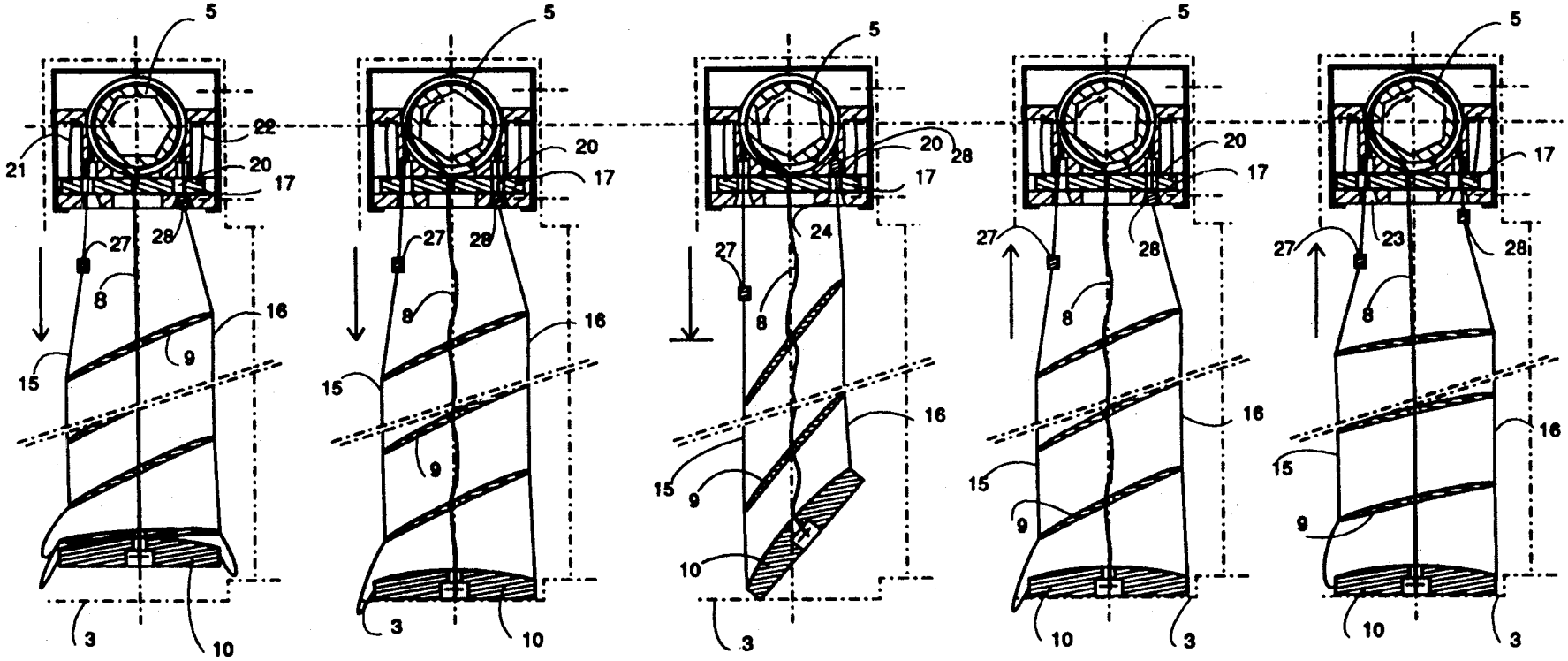
FIGS. 5 to 9 show the same blind in different positions.

The cradle 4 at the same time forms a frame for a slide 17 movable in translational motion under the piece 5 transversely relative to the axis of the drive shaft and in a horizontal plane. This slide 17 has a central passage 18 allowing the cord 8 to pass through with a little play. On each side of the passage 18, symmetrically in relation to this, the slide 17 has two rectangular passages 19 and 20 (FIG. 3). The slide 17 is furthermore connected to the cradle 4 by means of two spring leaves 21 and 22 which tend to keep the slide in a central position, as shown in FIG. 6, in the absence of any transverse stress.

Under the slide 17, the cradle 4 possesses two rectangular passages 23 and 24 coinciding or not coinciding with the passages 19 and 20 of the slide, depending on the position of the latter. Above the slide 17, the cradle 4 possesses two receptacles 25 and 26 located opposite the passages 23 and 24.

Fastened to the ends of the ladder carrier 13/14 are bar-shaped stop pieces 27 and 28, the dimensions of which are such that they can pass through the passages of the cradle and of the slide and penetrate into the receptacles 25 and 26.

Figure 4:
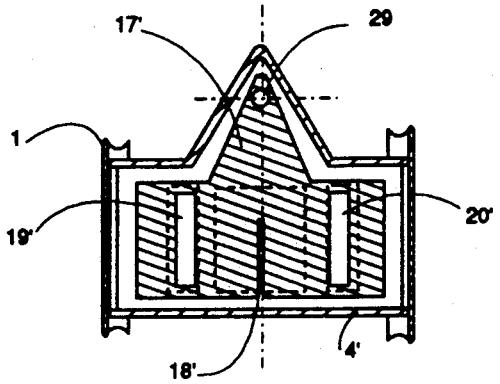
FIG. 4 shows an alternative embodiment of the slide in a view similar to that of FIG. 3.

According to an alternative embodiment illustrated in FIG. 4, the slide 17′ could be mounted pivotably about a vertical axis 29. The passage for the cord 8 could consist of a slit 18′. The spring for positioning the slide could be mounted in the region of the pivot axis 29.

The functioning of the blind will now be described by means of FIGS. 5 to 9.

FIG. 5 shows the blind in the descent position. The slat 10 is suspended and exerts a pull on the cord 8, the effect of this being to exert on the slide 17 a transverse force which displaces the slide 17 to the left counter to the action of its springs 21 and 22. The passage 20 of the slide is no longer opposite the passage 24 of the frame, the effect of this being partially to close off this passage 24. Since the piece 5 rotates in the direction of the arrow, the ladder carrier is frictionally driven in the same direction, in such a way that its stop 27 descends and its stop 28 ascends and engages into the passage 24 of the frame, but comes into abutment against the slide 17, thus determining a relatively low first inclination of the slats 9 of the blind.

When the lowermost slat 10 reaches the lower edge 3 of the window groove, the cord 8 slackens and releases the slide 17 which resumes its middle position under the effect of its springs. In this position, the passages of the slide coincide with the passages of the frame.

With the piece 5 continuing to rotate in the same direction and thereby driving the ladder, the stop 28 passes through the slide and comes into abutment on the bottom of the receptacle 26 of the cradle, causing the slats 9 of the blind to tilt into a relatively high second inclination, as shown in FIG. 7.

During the ascent of the blind, the piece 5 is driven in the direction of the arrow according to FIG. 8. The ladder carrier is driven in the other direction, and its stop 28 passes through the slide 17 in the downward direction. The slats 9 of the blind straighten up and the cord 8 is retensioned.

The tension of the cord 8 has the effect of displacing the slide 17 to the left again, the slide partially closing off the passage 23 of the frame (FIG. 9).

The stop 27 ascends until it comes into abutment against the slide 17, as shown in FIG. 2. The blind continues to ascend, the ladder carrier sliding on the piece 5.

Figure 10:
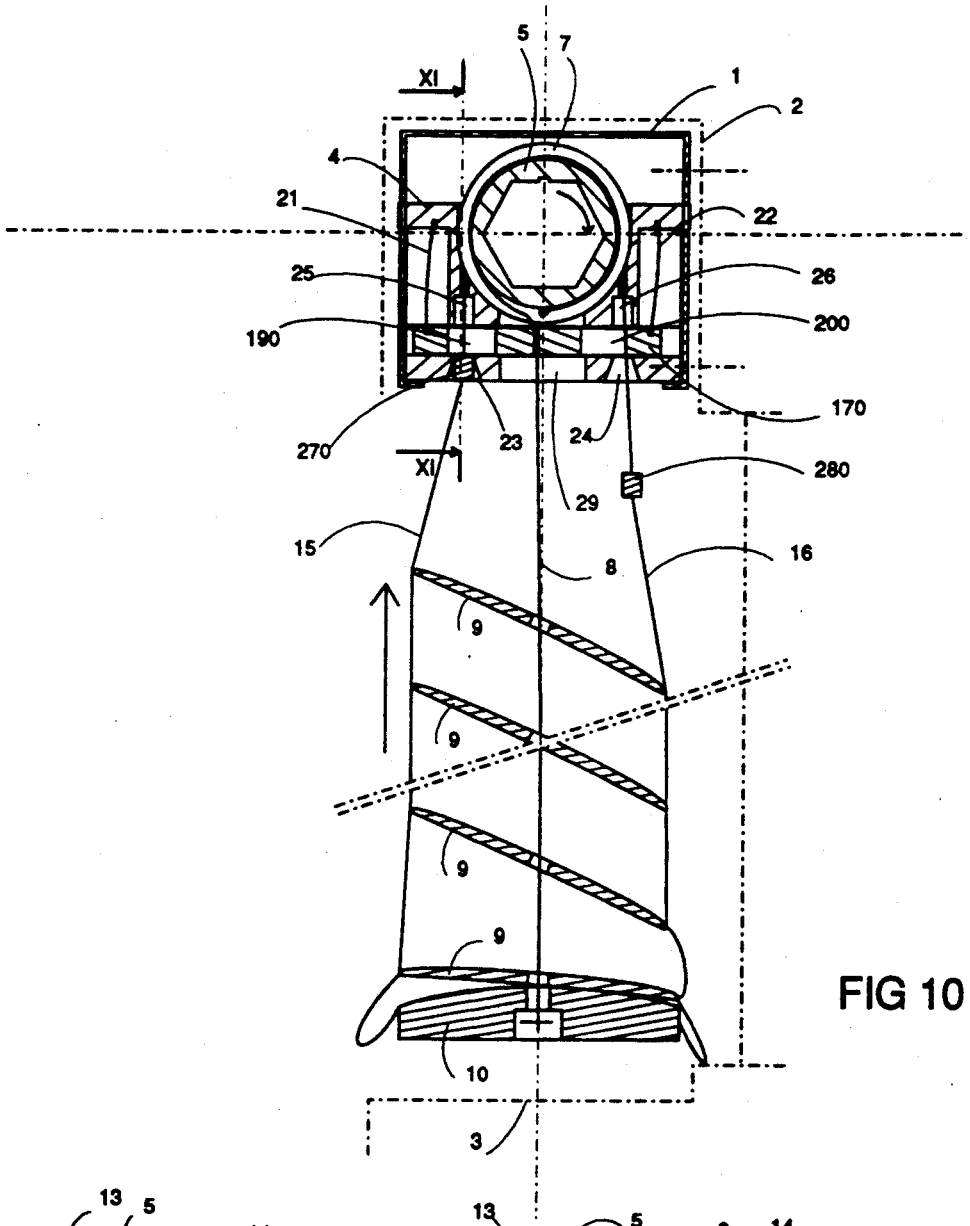
FIG. 10 shows a second embodiment in a view similar to that of FIG. 2.
Figure 11:
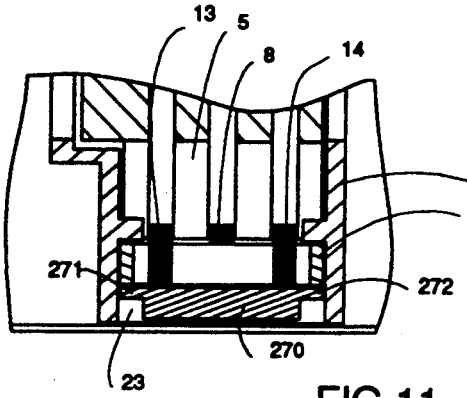
FIG. 11 is a partial view in the region of the slide according to line XI—XI of FIG. 10.

The second embodiment shown in FIGS. 10 and 11 differs from the first embodiment only in the dimension of the lateral passages of the slide 17, designated here by 170, and in the form of construction of the stops 27 and 28 designated by the references 270 and 280.

The slide 170 has lateral passages 190 and 200 wider than the passages 19 and 20, so that, when the slide 170 is displaced to the left, only the passage 24 of the frame is partially closed off. This makes a differentiation of the stop pieces 270 and 280 necessary. The stop piece 280 can be identical to the stop piece 28. In contrast, the stop piece 270 is equipped with two lateral arms 271 and 272 which prevent the stop from passing through the slide 170 by coming into abutment against this slide, as shown in FIG. 11. The stop 270 therefore never passes through the slide.

The functioning of this second embodiment is similar to the functioning of the first embodiment, the difference being that the stop piece 270 never passes through the slide.

Figure 12:
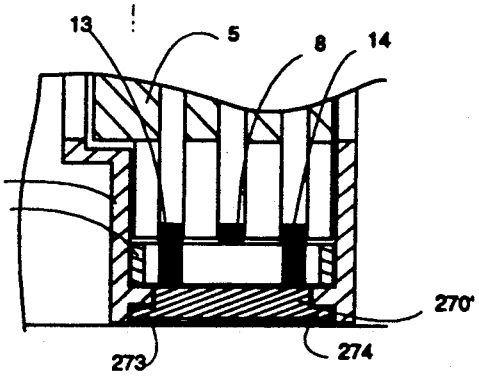
FIG. 12 shows an alternative embodiment of the part illustrated in FIG. 11.

FIG. 12 shows an alternative version of this second embodiment, in which the stop 270' is equipped with lateral arms 273 and 274 in its lower part, these arms coming into abutment against the cradle 4.

A particular embodiment of the stops 270 and 280 is shown in FIGS. 13 to 17.

The stop consists of a plastic plate 30 equipped with stubs 31 for fastening the ladder carrier, with a counterplate 32 connected to the plate 30 by means of a thinned part 33 forming a joint and equipped with snap tongues 34 and 35, and with two arms 36 and 37 connected to the plate 30 by means of two thinned parts 38 and 39 forming a joint, the arm 36 being extended downwards by an arm 40 and the arm 37 by an arm 41. The counterplate 32 is also provided with holes 42.

After the stubs 31 have been introduced into the ladder, the counterplate 32 is turned down and snapped on by means of its tongues 34 and 35. The end of the stubs 31 engages into the holes 42. The arms 36 and 37 can be left in their initial position, and a stop, such as that shown in FIGS. 15 and 16, is then obtained. Such a stop can pass through the passages of the frame. This applies to the stop 280.

In contrast, if the arms 36 and 37 are turned down laterally and kept in this position by the counterplate 32 which retains the arms 40 and 41, the stop shown in FIG. 17 is obtained. Such a stop can be used as the stop 270 in the embodiment illustrated in FIG. 10.

The stop shown in FIGS. 13 to 17 makes it possible to retain the advantage of symmetry in the second embodiment.

Figure 18:
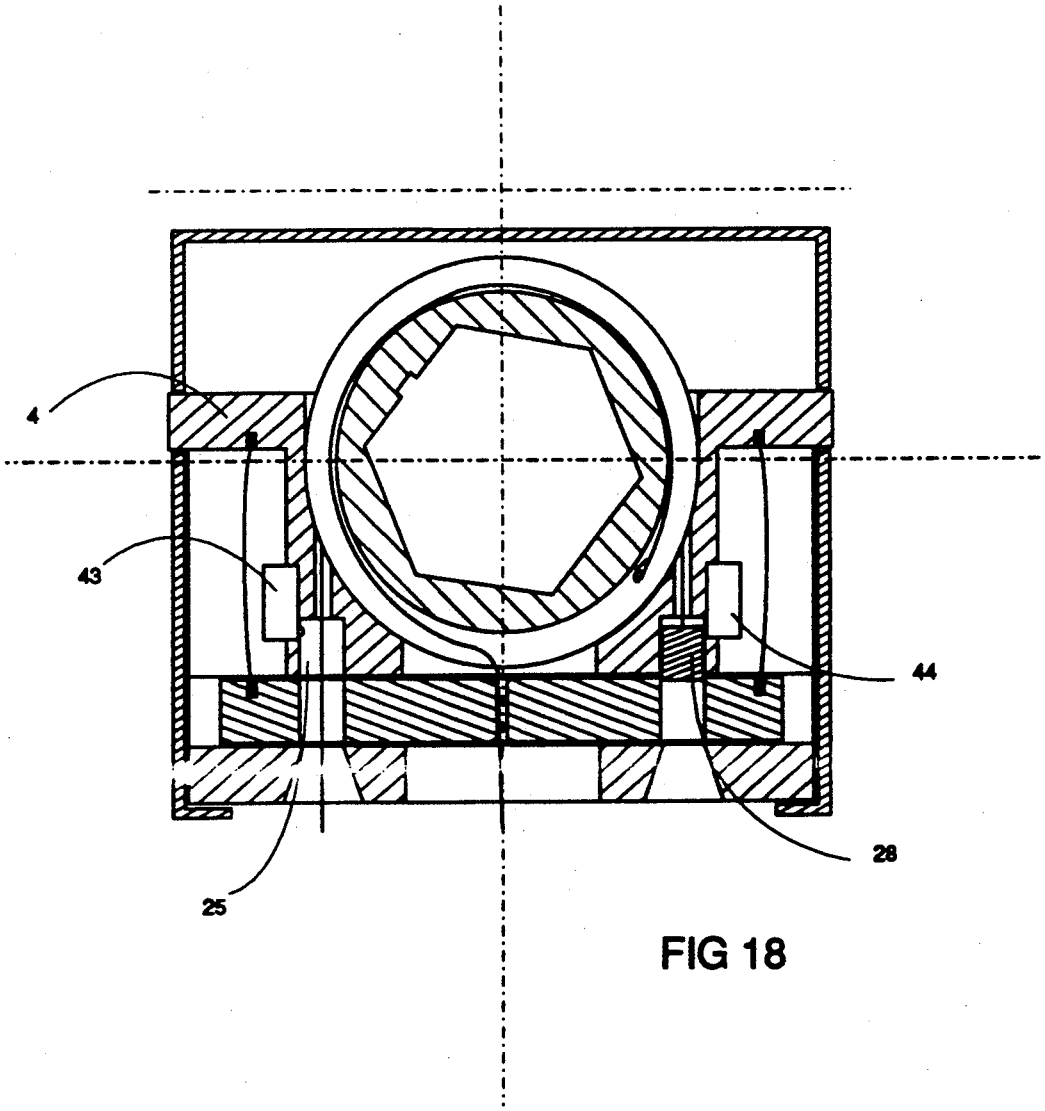
FIG. 18 shows an alternative version of the first embodiment.

FIG. 18 illustrates an alternative version of the first embodiment, in which two switches 43 and 44 have been arranged level with the receptacles 25 and 26, in such a way that they are actuated when the corresponding stop piece penetrates into the receptacle, for example the piece 28, as shown. This makes it possible to obtain a third automatic stopping point when the motor already inherently possesses a cage with two end-of-travel stopping points.

The embodiments and alternative versions illustrated are themselves capable of having many variations. In particular, the elastic positioning of the slide could be obtained in another way, for example by a spring located in the extension of the slide.

Figure 19:
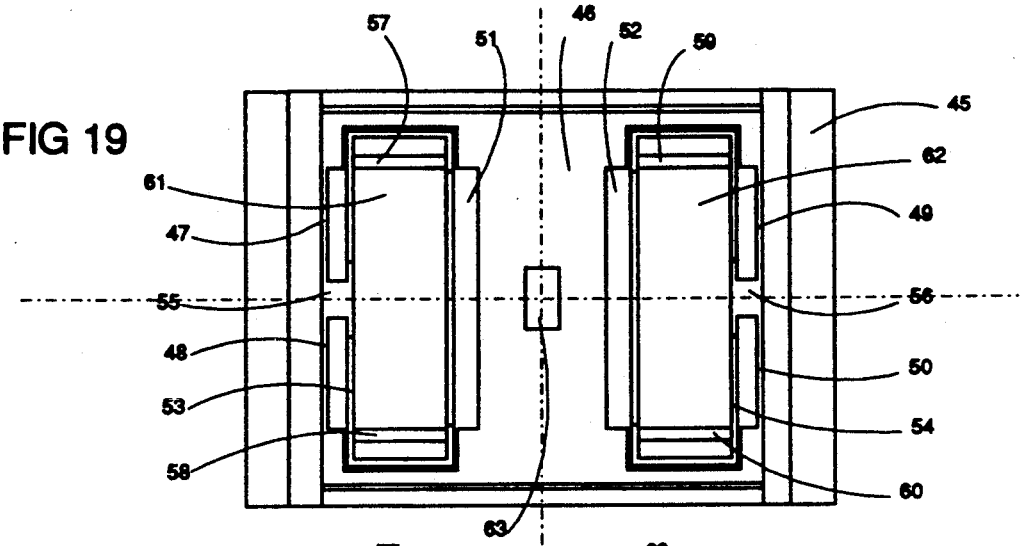
FIG. 19 is a bottom view of a one-piece embodiment of the cradle and slide in the position of rest.
Figure 20:
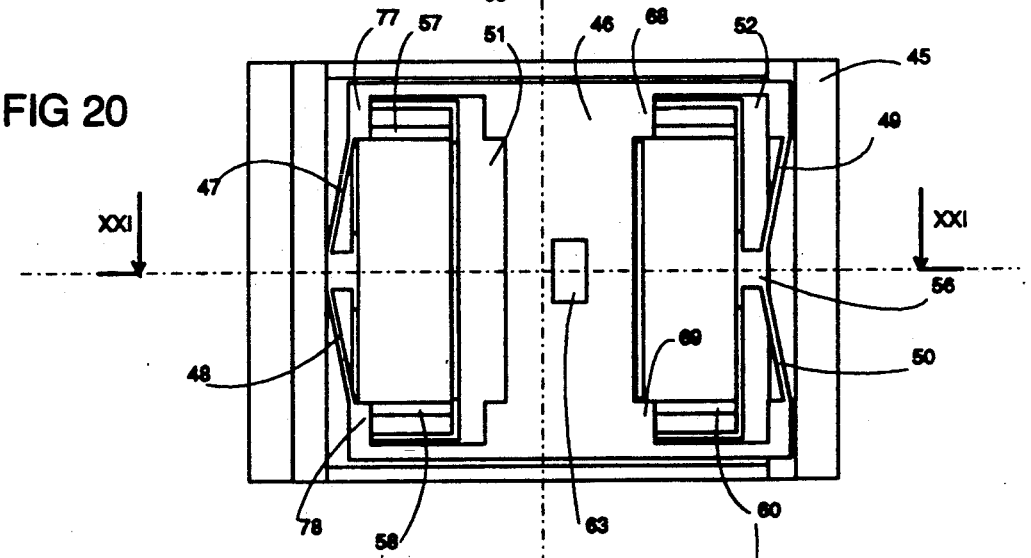
FIG. 20 shows the same embodiment in the working position in a sectional view according to line XX—XX of FIG. 21.
Figure 21:
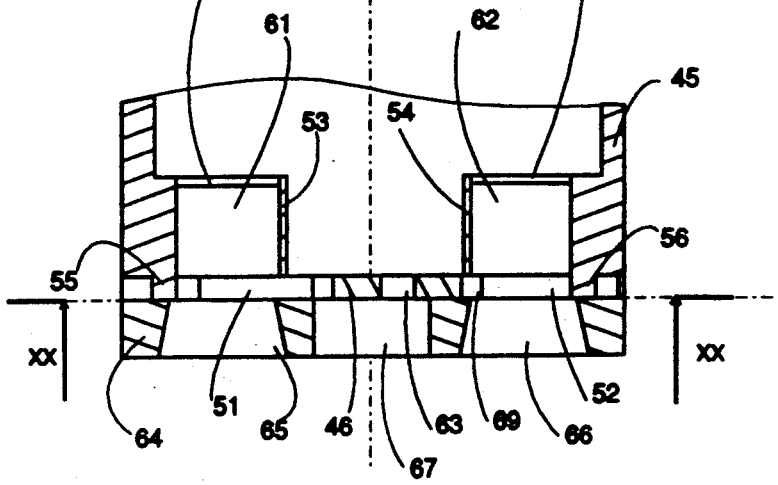
FIG. 21 is a partial sectional view according to line XXI—XXI of FIG. 20.

Should the slat orientation mechanism be made of plastic, the slide and its elastic positioning means can advantageously be produced in one piece with the cradle, for example as shown in FIGS. 19 to 21.

FIG. 19 shows a bottom view of a cradle 45 corresponding to the cradle 4 of FIGS. 1 and 2. It has two vertical lateral walls, on the left and right in the drawing, which are laid against the walls of the box 1. This cradle 45 is produced in one piece with a slide 46 located under the cradle and connected to the cradle 45 by means of two pairs of thin arms 47, 48 and 49, 50 which perform the function of the positioning springs 21 and 22 of the first embodiment. These arms are connected to the cradle by means of two bases 55 and 56.

The slide 46 has two cutouts 51 and 52 performing the function of the passages 19 and 20 of the first embodiment. Above these cutouts, the cradle 45 has two surrounds 53 and 54 which determine receptacles 61 and 62 similar to the receptacles 25 and 26 of the first embodiment and the bottom of which consists simply of two transverse bars 57, 58 and 59, 60 respectively.

The slide 46 is provided with a central passage 63, similar to the passage 18 of the first embodiment, for the passage of the cord 8.

The frame is completed by a plastic plate 64 which is welded or adhesively bonded to the cradle 45 under the slide 46. This plate 64 has a central passage 67 similar to the passage 29 and two lateral passages 65 and 66 similar to the passages 23 and 24 of the first embodiment.

The device, as shown in FIG. 21, functions in the same way as the device according to the first embodiment. Under the effect of the pull of the cord 8, the slide 46 is displaced to the right in the instance shown, in this case the stop 27 likewise being on the right. This stop 27 comes into abutment against the shoulders 68 and 69 of the slide. When the slide is in the position of rest, the stop 27 passes through the slide in order to penetrate into the receptacle 62.

It is possible to simplify further the production of the device by omitting the plate 64. In this case, the slide 46 becomes a simple plate movable under the cradle. The device takes the form shown in FIGS. 19 and 20.

Since the plate 64 served for guiding and centering the stop pieces, it became appropriate to ensure this guidance and centering by another means. This is achieved by giving the stop pieces a special shape, this shape being shown in FIG. 22.

The stop pieces have a stepped profile, namely an upper part 70 in the form of a truncated pyramid and profiled so as to have four shoulders, three 71, 72 and 73 of which can be seen. Underneath these shoulders, the stops consist of a prism-shaped part 74. One of the stop pieces possesses, furthermore, two wings 75 and 76 and corresponds to the stop 270' of FIG. 12.

When the device is in the position of rest shown in FIG. 19, the pyramidal part 70 of the stops passes through the movable piece 46 and engages into the corresponding receptacle 61 and 62, thereby centering the stop piece in this receptacle. The stop piece equipped with the wings 75 and 76 comes into abutment with its wings against the edges of the movable piece 46. The other stop can penetrate as far as the bottom of the receptacle 61.

Figure 22:
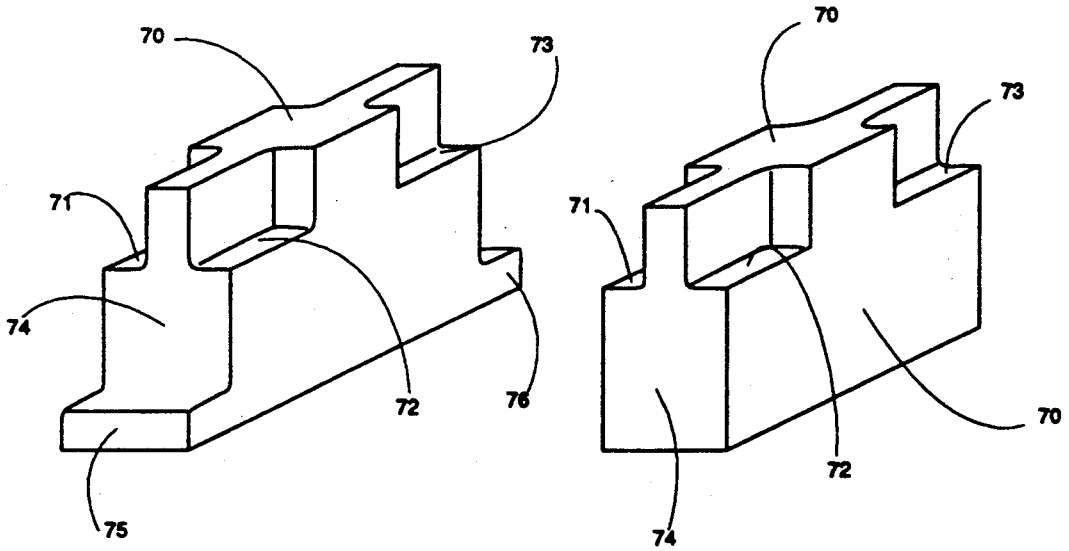
FIG. 22 shows a particular embodiment of the stop pieces making possible a simplification of the embodiment illustrated in FIGS. 19 to 21.

When the movable piece 46 is displaced, for example to the right, as shown in FIG. 20, the stop piece shown on the right in FIG. 22 comes into abutment with two of its shoulders 71 and 73 against the shoulders 68 and 69 of the movable piece 46.

The device therefore functions in the same way as the second embodiment.

I claim:

1. A venetian blind comprising a plurality of slats, a winding drum having a longitudinal axis, said winding drum mounted on a stationary frame, a cord wound on said winding drum, said cord passing through said stationary frame and said plurality of slats and fastened to a lower most slat, said drum having a pully means thereon drivingly connected to a flexible ladder, said flexible ladder having two bands connected to edges of said slats to tilt said slats, a movable member mounted below said drum and mounted to move transverse to said drum longitudinal axis, said movable member having band passages and a cord passage, said bands passing through said band passages and said cord passing through said cord passage, a first stop means attached to one of said bands above an uppermost slat, a second stop means attached to another of said bands above said uppermost slat, said band passages having a size to allow passage therethrough of said stop means, said cord being positioned relative to said movable member to move said movable member to at least a stop position and a non-blocking position, means associated with said movable member in said stop position to block passage of said stop means through said band passages.

2. A venetian blind according to claim 1 wherein said movable member has a slide (17; 170; 46) movable on the inside of the frame (4; 45, 64) above passages (23, 24; 65, 66) in the frame.

3. A venetian bldind according to claim 2, wherein the slide (17) has band passages (25, 26) of a width substantially equal to that of band frame passages (23, 24).

4. A venetian blind according to claim 2, wherein the slide (170) has band passages (190), 200) of a width substantially greater than that of the band frame passages, and the first stop means (270) is sized to prevent the first stop means from passing through a corresponding frame passage.

5. A venetian blind according to claim 4, wherein the stop means are equipped with orientable arms (36, 37) capable of being arranged in an operative or inoperative position, the stop means being incapable of passing through the corresponding frame passage when these arms are arranged in the operative position.

6. A venetian blind according to claim 5, wherein the stop means are plastic and have a plate (30) equipped with stubs (31) for fastening to the two orientable arms (36, 37) connected to a plate by a thinned part, each plate having a locking arm (40, 41) a counterplate (32) articulated on the side of the plate and capable of being turned down and snapped onto the plate to maintain the locking arms in a desired position.

7. A venetian blind according to claim 1 wherein the pulley (11, 12) and the drum (7) are in one piece mounted in a cradle (4; 45) which forms said frame.

8. A venetian blind according to claim 2, wherein the frame has two attached plastic pieced (45, 64), the slide (46) is with an upper part (45) of the frame by means of thin arms (47, 48, 49, 50) forming an elastic positioning means of the slide.

9. A venetian blind according to claim 1, wherein said movable piece (46) is plastic and has a plate arranged under the frame (45) and has thin arms (47, 48, 49, 50) forming said elastic positioning means of the plate, and the stop means are shaped (70) so as to ensure their self-centering in the passages of said movable piece (46).

10. A venetian blind according to claim 9, wherein the stop means have a stepped shape (70 to 74).

11. A venetian blind according to claim 1, wherein limit switches (43, 44) are arranged above said movable piece and actuable by said stop means.

* * * * *